US009339718B2

(12) United States Patent
Cornillon

(10) Patent No.: US 9,339,718 B2
(45) Date of Patent: May 17, 2016

(54) ASSISTANCE SYSTEM FOR A GLIDING BOARD OR SNOWSHOE

(76) Inventor: Patrice Cornillon, Valdeblore (FR)

( * ) Notice: Subject to any disclaimer, the term of this patent is extended or adjusted under 35 U.S.C. 154(b) by 198 days.

(21) Appl. No.: 14/113,194

(22) PCT Filed: Apr. 19, 2012

(86) PCT No.: PCT/EP2012/057226

§ 371 (c)(1),
(2), (4) Date: Dec. 30, 2013

(87) PCT Pub. No.: WO2012/143482

PCT Pub. Date: Oct. 26, 2012

(65) Prior Publication Data

US 2014/0103620 A1 Apr. 17, 2014

(30) Foreign Application Priority Data

Apr. 21, 2011 (FR) ..... 11 01267

(51) Int. Cl.

| | |
|---|---|
| ***A63C 9/00*** | (2012.01) |
| ***A63C 13/00*** | (2006.01) |
| ***A63B 25/10*** | (2006.01) |

(Continued)

(52) U.S. Cl.

CPC . *A63C 9/00* (2013.01); *A63B 25/10* (2013.01); *A63C 9/006* (2013.01); *A63C 13/001* (2013.01); *A63C 13/008* (2013.01);

(Continued)

(58) Field of Classification Search

CPC ..... A63B 25/10; A63B 224/19; A63C 9/006; A63C 9/0807; A63C 9/00; A63C 9/20; A63C 9/02; A63C 13/001; A63C 13/008; A63C 17/0046; A63C 17/065; A43B 5/0421; A43B 5/1658; A43B 5/18; A43B 5/185; A43B 13/18; A43B 13/182; A43B 13/184

See application file for complete search history.

(56) References Cited

U.S. PATENT DOCUMENTS 1,670,747 A * 5/1928 Sestito ..... 36/28
1,726,028 A * 8/1929 Keller ..... 36/7.8

(Continued)

FOREIGN PATENT DOCUMENTS

DE 3017769 A1 * 1/1982
DE 19917960 C1 * 10/2000 ..... A63C 11/00

(Continued)

OTHER PUBLICATIONS

European Patent Office International Search Report and Written Opinion dated Aug. 6, 2012, International Application No. PCT/EP2012/057226 (9 pages).

*Primary Examiner* — Paul N Dickson
*Assistant Examiner* — Steve Clemmons
(74) *Attorney, Agent, or Firm* — McCracken & Gillen LLC

(57) ABSTRACT

The present invention relates to a system for helping the movements of a user's foot, said foot being able to be received in a footwear portion, the front end of which is pivotably mounted relative to a sliding board or to walking equipment, with the system comprising a spring which can be secured to the sliding board or to the walking equipment so as to be applied to a bearing zone of the footwear portion by exerting a pressure on said bearing zone when the bearing zone is moved closer to the sliding board or to the walking equipment, characterized in that it comprises a binding device which can be removed from the spring, with the binding device being able to be fastened to a binding zone of the sliding board or of the walking equipment.

17 Claims, 9 Drawing Sheets

(51) Int. Cl.
*A63C 9/02* (2012.01)
*A63C 9/20* (2012.01)

(52) U.S. Cl.
CPC ..... *A63B 2244/19* (2013.01); *A63C 9/02* (2013.01); *A63C 9/20* (2013.01)

(56) References Cited

U.S. PATENT DOCUMENTS 1,789,182 A * 1/1931 Klevstad ..... 280/11.15
2,552,393 A * 5/1951 Benner, Jr. ..... 36/7.8
3,862,751 A * 1/1975 Schwaller ..... 267/91
3,944,237 A * 3/1976 Teague, Jr. ..... 280/618
4,002,354 A * 1/1977 Ramer ..... 280/614
4,139,214 A * 2/1979 Meyer ..... 280/607
4,157,191 A * 6/1979 Ramer ..... 280/614
4,392,666 A * 7/1983 Ramer ..... 280/614
5,282,325 A * 2/1994 Beyl ..... 36/27
5,425,531 A * 6/1995 Perrault ..... 267/180
5,435,079 A * 7/1995 Gallegos ..... 36/38
5,503,413 A * 4/1996 Belogour ..... 280/11.225
5,586,774 A * 12/1996 Dentale ..... 280/11.225
5,842,706 A * 12/1998 Chang ..... 280/11.28
5,875,567 A * 3/1999 Bayley ..... 36/27
5,979,916 A * 11/1999 Gatel et al. ..... 280/11.224
6,006,449 A * 12/1999 Orlowski et al. ..... 36/27
6,209,889 B1 * 4/2001 Alfieri et al. ..... 280/11.224
6,393,731 B1 * 5/2002 Moua et al. ..... 36/27
6,736,412 B1 * 5/2004 Krah ..... 280/11.224
6,901,686 B2 * 6/2005 Hayes ..... 36/27
8,065,817 B2 * 11/2011 LeVert et al. ..... 36/27
8,112,905 B2 * 2/2012 Bemis et al. ..... 36/27
8,272,146 B1 * 9/2012 Jackson, II ..... 36/27
2008/0116663 A1 * 5/2008 Gyr ..... 280/611

FOREIGN PATENT DOCUMENTS

DE 102010026186 1/2011
FR 2253346 A5 * 6/1975
FR 2302116 9/1976
FR 2507486 A * 12/1982
WO 9517109 6/1995
WO WO 9842221 A1 * 10/1998 ..... A43B 13/28

* cited by examiner

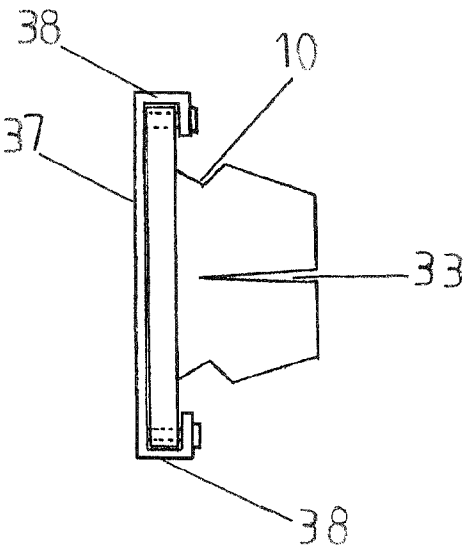
FIG. 7
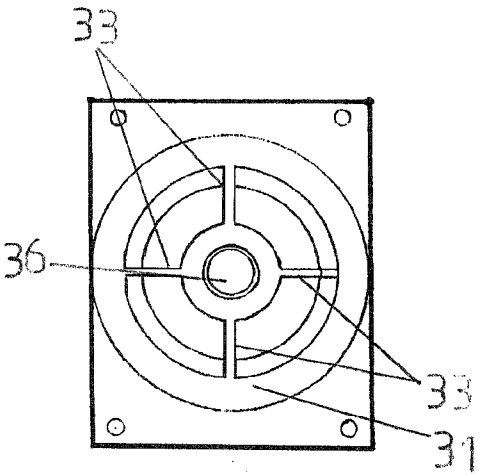
FIG. 8
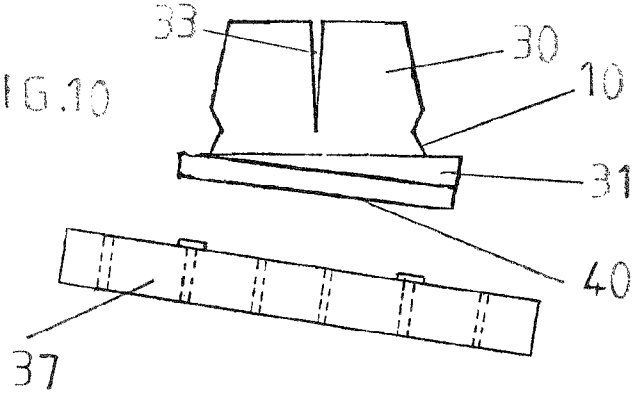
FIG. 10
FIG. 11
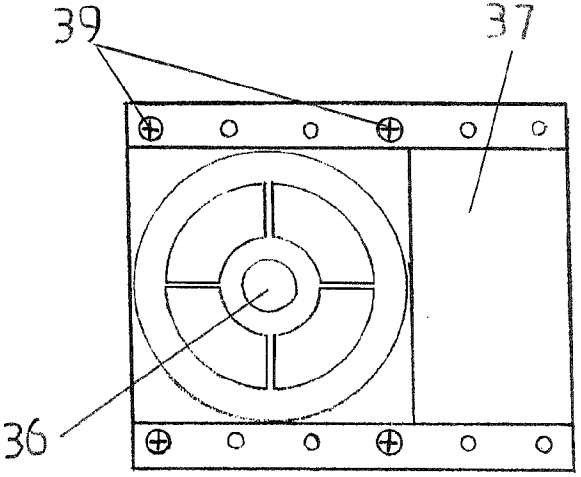
FIG. 9

ASSISTANCE SYSTEM FOR A GLIDING BOARD OR SNOWSHOE

TECHNICAL FIELD OF THE INVENTION

The invention relates to a system for helping the movements of a user's foot provided with a binding device making it possible to place a spring or the like on a sliding board or walking equipment. The spring is compressed by the shoe, the front end of which is also fastened to the support (a sliding board such as downhill skis, cross-country skis or touring skis) or walking equipment (such as walking boards or snowshoe spikes, or snowboards).

When lifting the foot, a pulse is given by the spring which facilitates the movement and allows the tripper a faster climbing or movement with a minimum exertion.

STATE OF THE PRIOR ART

Cross-country skis, touring skis or snowshoes are currently equipped with bindings making it possible to have the back of the foot detached for walking or climbing. The front part is fastened to the sliding board or the snowshoes. The heel can thus be raised, which enables to move forward. Traditionally, only the tripper's muscular strength allows raising the heel from an inert climbing wedge.

For touring skis, a patent DE 19917960 C1 published by the inventor HIEBLER Anton, dated Dec. 10, 2000, discloses various solutions for mechanically helping a touring skier lift his/her foot. The solution of a steel spring is mentioned therein. The spring is fastened directly on the ski or on the front fastening plate. Several drawbacks result from this solution:

1) The spring remains in place during the descent, which forces the back bindings of the ski shoes and entails a risk of pulling these which is all the more important since touring skis bindings are getting lighter and lighter with a less massive structure, especially in competition.

2) The presence of the spring during the descent causes a frictional force which may affect the release of the shoes bindings during a fall.

3) The tripper will always be equipped with the same spring which may turn out to be too long and annoying on flat portions and too short and lacking efficiency on steep slopes.

4) The spring is positioned perpendicularly to the ski which makes it impossible to give the ideal impulse on the shoe.

5) Placed on the front fastening plate, the conical spring is an obstacle for positioning knives on steep slopes or ice patches, and this is even more cumbersome with the flat spring shown in Mr. HIEBLER Anton's FIG. 4.

The document FR-A-16 23 021 discloses a ski binding that incorporates a spring system liable to rest on a pivoting plate supporting a ski shoe. This technique implies that the spring is very closely linked to the binding which requires a specific binding with larger dimensions and a heavier weight. Besides, no flexibility in use is permitted. The elastic support is provided at the foot heel and the applicant has found that this location was not satisfactory in terms of thrust.

The document DE-A1-102 010 026 186 discloses a set of equipment composed of a ski and a plate provided with a flexible blade. This blade is located at the heel of the user's foot. It is not fastened to the ski and the configuration thereof is complex and cumbersome.

SUMMARY OF THE INVENTION

The present invention relates to a system for helping the movements of a user's foot, said foot being able to be received in a footwear portion, the front end of which is pivotably mounted relative to a sliding board or to walking equipment, with the system comprising a spring which can be secured to the sliding board or to the walking equipment so as to be applied to a bearing zone of the footwear portion by exerting a pressure on said bearing zone when the bearing zone is moved closer to the sliding board or the walking equipment, characterized in that it comprises a binding device which can be removed from the spring, with the binding device being able to be fastened to a binding zone of the sliding board or the walking equipment.

Advantageously, the term "removable" means that the removal of the spring requires no tools. In general, removability involves the possibility to fasten and to remove the spring when doing the sport, without any non-portable tool.

The system according to the invention may optionally have at least one of the following characteristics:

- a system wherein the spring is a helical spring, one end of which is removeably mounted on the binding device and the other end of which is so configured as to face the bearing zone;
- the binding device comprises a groove-shaped notch so configured as to releasably retain at least one turn of the spring;
- the notch is situated on a fitting portion extending above a base portion which is wider than the fitting portion;
- the spring abuts on the base portion;
- the fitting portion has a tapered shape, the base of which is directed towards the base portion;
- the fitting portion is hollow and has at least one longitudinal slot opening at the end of the fitting portion opposite the base portion and so configured as to allow a reversible narrowing of the fitting portion section;
- the system comprises at least two slots diametrically opposed around the fitting portion;
- the slot or slots has (have) a decreasing width toward the notch ending at said slot;
- the binding device comprises a slide able to be fastened to the sliding board or the walking equipment and an adjustable part able to be fastened in several positions to the slide, the adjustable portion being so configured as to removeably fasten the spring;
- the system comprises at least one additional spring able to be alternately removeably fastened to the spring and different from the spring by at least one of the following characteristics: the length, the diameter, the stiffness thereof.

The present invention also relates to a set of equipment for doing a mountain-sport comprising at least a sliding board or walking equipment and at least one system as described above.

Optionally, the set of equipment of the invention may have at least any one of the following optional features:

- the binding zone is located on the sliding board or the walking equipment so as to be able to be positioned opposite the arch of the user's foot;
- the set of equipment has a footwear portion which comprises a shoe, the sole of which comprises a recessed portion wherein the bearing zone is located, with the height of the binding device being so configured as to be inserted into the recessed portion;
- it also has a footwear portion which comprises a fastening plate pivotally mounted relative to the sliding board or the walking equipment and adapted to receive the sole of a shoe, with said fastening plate cooperating with a movable member whereon the bearing zone is formed, with the movable member being movable between an active position wherein the bearing zone cooperates with the help system and an inactive position wherein the help system does not cooperate with the bearing zone.

said fastening plate has a hole wherein the spring is inserted in the inactive position, the hole being closed by the movable member in the active position.

Advantageous but not restricting possibilities of the invention are mentioned hereunder:

a binding device for fastening a propulsive spring facilitating the lifting of the heel of the shoe fastened at the front to the binding, which is itself fastened to a sliding board, or walking equipment characterized in that it allows fixing at least one spring or the like positioned at the foot level, between the sole of the shoe or the plate for fastening the shoe and the sliding board or walking equipment;

said binding device is inclined to allow a maximum thrust force during the lifting of the foot;

said binding device comprises a system for holding the spring in the mounted position, which may be a notch;

said at least one spring or the like is removeably fastened to the binding so that it can be removed when descending;

the strength of said at least one spring or the like is adjusted to the user's weight;

said at least one spring or the like may be adjusted or exchanged to have a size adapted to the degree of the considered slope;

a heel stop prevents leverage on the front binding when the spring is completely crushed. The height of such stop is adapted to the rest of the binding device;

said binding device has a suitable height according to the depth of the shoe arch.

The binding device of the invention advantageously allows fastening a powerful spring between the shoe or the shoe fastening plate and the sliding board or the walking equipment. Such spring will help the tripper lift his/her foot and will prevent him/her to be tired. The binding device according to the invention allows to make the spring removable and inclined in the manner most suited to the type of board (a sliding board or walking equipment) and shoe (or shoe fastening plate).

The device according to the invention advantageously allows to position the spring with an inclination adapted to the type of the board and of the shoe or the shoe fastening plate, making it most efficient when climbing on touring skis, cross-country skis or walking equipment. The binding device according to the invention also allows the spring to be removable, mainly for downhill or touring skiing. The spring can be removed quickly, before going down, so as not to interfere with the rear engagement of the shoe with the usual binding for ski shoes.

For downhill or touring skiing the binding device remedies at least partly the drawbacks mentioned above:

Advantageously, the spring retainer according to the invention is placed at the arch so that it undergoes a maximum compression based on the skier's weight and therefore it returns a maximum thrust when lifting the foot.

The binding device according to the invention is a fixed support of small thickness, less than the free space left between the sliding board and the pit of the plantar arch. The height of the support is preferably less than the depth of the plantar arch of the shoe.

This support enables to removeably fix a spring so that it can be removed quickly before the descent.

Preferably, a notch is provided at the base of the binding. The spring is placed in the slot, which allows it to stay in place when climbing.

The spring can be removed by a pivot effect exerted by the skier's hand, allowing it to get out of the notch. The spring fastening support according to the invention then remains on the board, only, and does not interfere with the raised foot and the rear engagement of the shoe for the descent. There is no risk for the shoe bindings to be torn or worn (a solution to drawback 1) and the release in case of a fall is not hampered (a solution to drawback 2).

The height of the spring may vary according to the type of slope selected by the user. The latter will be able to fasten to the support a spring, the length of which is the most suitable (a solution to drawback 3).

A heel wedge adjustable in height (present on all the rear bindings currently marketed), prevents the leverage that could be exerted on the front binding, and takes up the raised height of the foot (resulting from the various types of shoe bindings marketed) relative to the sliding board.

Preferentially, the height of the support-compressed spring assembly shall not exceed that of the space between the sliding board and the pit of the plantar arch. Hence the importance of being able to provide two springs: one for the low wedge and one for the climbing high wedge.

Preferably, this height is adjustable when positioning the binding with the addition or not of a spacer between the binding and the sliding board.

Not to oppose the compression of the spring on the support, the latter may advantageously have a slightly conical shape.

In addition, the spring support is inclined to adapt to the inclination of the shoe in front of the heel, at the shank (waist between the flat part of the sole and the heel) (a solution to drawback 4).

The final turns of the spring may have close ends (ground or not) in order to adapt to the flat sole of the shoe and to the spring support, according to the invention.

This support is preferably screwed (or glued) at the arch onto the board, using a central screw. This leaves free space for the insertion of knives at the front binding (a solution to drawback 5).

The spring must advantageously be resistant (according to the skier's weight), not corrodible by rust and as light as possible.

The spring fastener may be made of a resistant plastic material or any other material with the same characteristics (resistance to cold and wear).

For snowshoes, the binding device according to the invention is substantially similar to the device described for touring or mountaineering skis.

Some changes may however be made:

It must adapt to the numerous types of snowshoes currently existing on the market. It may thus be screwed (or glued) onto the central platform of the stringing of the walking snowshoe, moulded with this platform, or bolted into a hole (e.g. the setting of shoes on certain types of snowshoes) so as to be adjustable to the size of the shoe.

The inclination shall no longer depend on that of the arch of the shoe, but shall be perpendicular to the shoe fastening plate in low position (when the shoe rests on the climbing wedge of the shoe provided on the marketed snowshoes).

The spring will not necessarily be removed when descending, since the back of the foot remains free. It is therefore possible for it to remain in place and be used as a descent damper. The solution of a removable spring however remains interesting because snowshoes are suitable for users whose weight may vary (within a certain range). The spring may thus be changed according to the user's weight.

Moreover, according to one embodiment, the spring may remain in place, but go through the shoe fastening plate (drilled beforehand) when the tripper is descending. When climbing, the hole in the shoe fastening plate will be filled by a movable member such as a sliding plate whereon the spring may rest and be propulsive.

BRIEF DESCRIPTION OF THE FIGURES

Other advantages and characteristics will become more apparent from the following description of specific embodiments of the invention, given by way of non-restricting examples and illustrated in the accompanying drawings wherein:

FIGS. 7 to 11 show another embodiment wherein the position of the spring bearing region is adjustable;

DETAILED DESCRIPTION OF ONE EMBODIMENT

Figure 1:
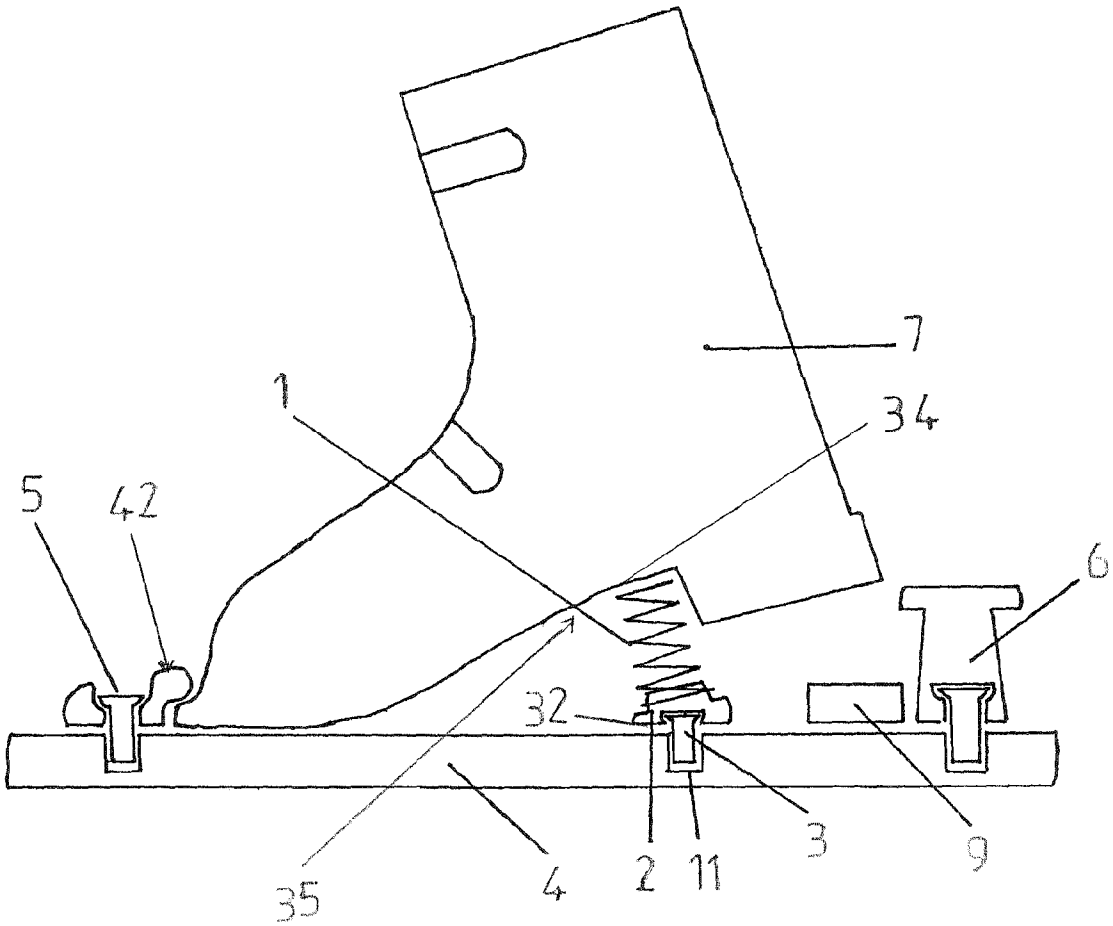
FIG. 1 shows a vertical longitudinal section of the shoe, sliding board, shoe binding, spring and retainer assembly according to the invention.

In general, the system of the invention may be provided on any support used when doing mountain sports wherein the user has to walk. To this end, the support such as a gliding board (touring skis for example) or walking equipment (a walking board, a spiked board or a snowshoe) receives a binding adapted to cooperate with the tip of the user's shoe, so that the shoe can pivot closer to or away from the support heel. Bindings of the same type as those used for touring skis are an example used for the point pivot 42.

The support thus directly or indirectly cooperates with a shoe 7 to execute this movement. Footwear portion means here the assembly which pivotably moves relative to the support. This part may be composed of the shoe 7 only or may comprise an additional device such as a plate 8 whereon the shoe 7 rests, with the plate itself being pivotable relative to the support.

The help system proposed here comprises a binding device 2 which is intended to be securely fastened to the support at a binding region 32. Screwing may be used for this purpose. The device 32 cooperates with a spring 1 advantageously of the helical type, so that the spring can be installed or removed at will according to the phases of use. Thus, the spring may be manually removed during descent phases during which the shoe 7 cooperates with a rear binding of the support, at the heel. The spring may also be replaced with another one depending on the desired stiffness, and the clearance required (spring length is changed). The system of the invention is thus flexible and may be adapted, for example, to users of different weights, by selecting the appropriate spring.

To reach this versatility, the binding device 2 is so configured as to provide the removable positioning of the spring 1.

In the Figures, the spring 1 is inserted around a fitting portion 30 of the binding device 2 until a notch 10, that is to say, a recessed groove on the outer surface of the fitting portion 30, is reached. Advantageously this groove is in front of the fitting portion 30 and also provides bearing to the spring 1, while abutting on a base portion 31 of the binding device 2. The presence of the notch provides an important but removable attachment without requiring a long fitting which would involve a significant height of the device 2. For example, the height from the surface of the support to the top of the device 2 (at the high end of the fitting portion 30, in particular) may be less than 2 centimeters and preferably greater than 1 centimeter.

Thus, by placing the binding region 32 to a point on the support such as a bearing point, on the sole of the shoe at the arch, the device 2 can be housed in the hollow recess of the sole, thus avoiding having to disassemble the binding device 2 in descent position.

In addition, the device 2 such as the spring 1 is applied to a bearing zone 34 of the footwear portion located in the arch which enhances the efficiency of the help system: this area is less prone to lateral movements of the foot, since the length of the spring for a pivoting on a given angle sector is smaller. Moreover, this selected position also enables to use a stiffer spring because the distance to the pivot point is smaller.

The position of the bearing region 34 can also be adjusted at the waist of the shoe as shown in FIGS. 7 to 11. The binding device 2 then comprises a slide 37, here as a plate, the two side edges of which are folded upwards to form a pair of ribs 38 oriented along the length of the foot. The slide 37 cooperates by sliding with the base portion 31 so as to guide the latter in translation. Means are provided for stopping the translation in the adjusted position. Screws 39 passing through holes in the slide 37 and the base portion 31 may be suitable.

For touring skis, according to a first preferred embodiment of the invention shown in FIG. 1, the shoe 7 is attached to the front by the binding 5 on the sliding board 4. Between the sliding board 4 and the shoe 7, at the arch just before the heel, a spring 1 is fitted onto a binding device 2. Said binding device 2 is attached to the sliding board 4 by means of a screw 3 screwed into a bore 11. A stop 9 prevents the leverage that could be exerted on the front binding 5 when the spring is fully compressed. This stop 9 is no longer necessary on skis equipped with ski brakes. Before the descent, the spring 1 can be removed by a pivot effect exerted by the skier's hand. The shoe 7 can then be engaged into the binding 6 to start descending with the touring skis.

Figure 2:
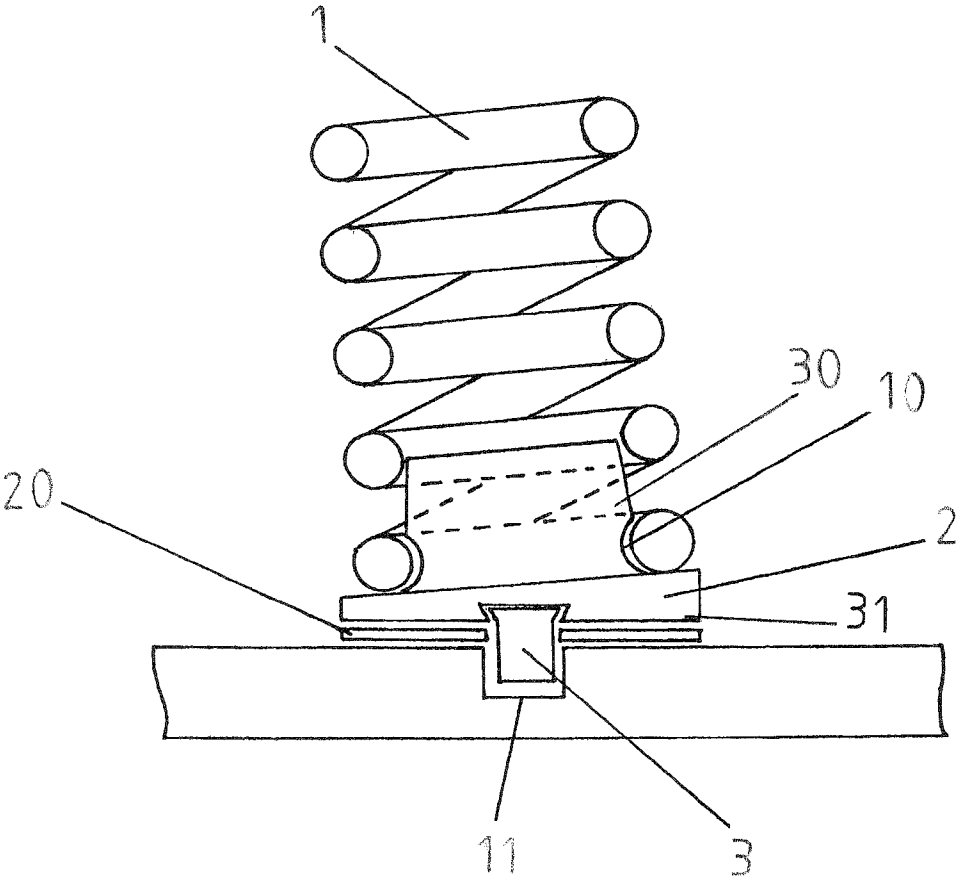
FIG. 2 is a vertical longitudinal section of the spring retainer according to the invention and the spring in position.

A detailed view of the binding 2, especially made of plastic can be seen in FIG. 2. This binding is slightly conical to allow the spring to snap into the notch 10 without causing friction, but also to allow the spring to be compressed on the first turn, without being hindered by the binding support 2. The binding 2 is slightly inclined (the angle relative to the sliding board, is between 80° and 85° depending on the type of shoe) to be able to provide a maximum thrust on the shoe 7 and remain parallel to the sole of the shoe when the spring 1 is compressed.

FIG. 10 shows that the mounting surface forms a non-right angle with respect to the longitudinal axis of the fitting portion 30 to achieve the inclination.

A notch 10 holds the spring when climbing and allows it to be easily removable before the descent. A spacer 20 is used to adjust the height of the binding 2 to the depth of the arch of the shoe 7.

In the case of FIGS. 5 to 11, the binding device 2 comprises in the fitting portion 30, at least a slot 33, the portion 30 also being hollow with a central hole 36. A pair of slots 33 may also be provided so as to permit a reduction in the diameter of the fitting portion 30 when mounting the spring 1. Each slot 33 preferably has a decreasing width toward its base and opens out at the upper end of the fitting portion 30. At this level, for example, the width of the slot is between 10 to 20% of the perimeter of the central hole 36.

In addition, the slots 33 advantageously extend up to the slot 10.

Figure 6:
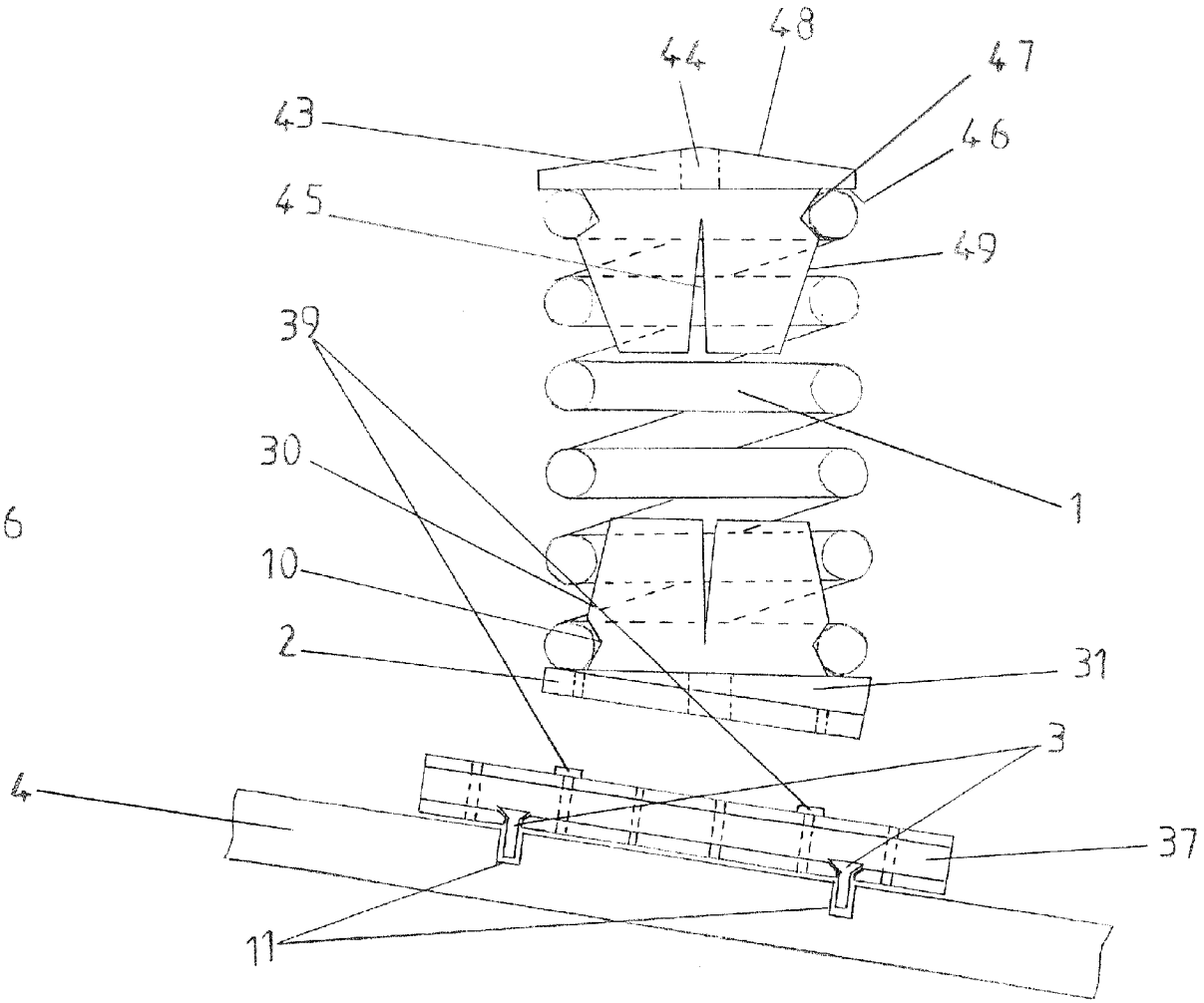

FIG. 6 shows in detail one embodiment of the invention incorporating the binding device 2, the spring 1 and a tip 43 covering the spring 1 at the upper end thereof. Then the tip 43 transmits the thrust from the spring 1 to the base of the footwear portion via the bearing area 34. The tip 43 can have a configuration similar or identical to that of the binding device 2, as regards shape and dimensions. In particular the spring 1 is preferentially mounted on the tip 43, as is the binding device 2, namely with a sleeve portion 49 advantageously provided with slot(s) 45. A tip notch 47 is provided to receive at least the upper end turn of the spring 1. A base 46 extends the assembly upwards. Its outer surface provides contact with the bearing zone 34 and for example as at least an inclined portion or a top portion 48 as shown. The internal face of the base 46 may be used as a stop for the spring 1.

The base 46 or another portion of the tip 43 may be provided with connecting means configured for connecting the tip 43 to another element such as the ski binding. Thus the system of the invention cannot be lost if it comes off unexpectedly.

The preferred summit shape 48 can act as an ice- or snow-breaker to prevent snow accumulation at the bearing zone 34 and/or snow accumulation in the spring 1.

Advantageously, the surface of the tip 43 and that of the binding device 2, located opposite each other, are such that they abut before the turns of the spring 1 join. This prevents degradation of the spring 1.

Figure 3:
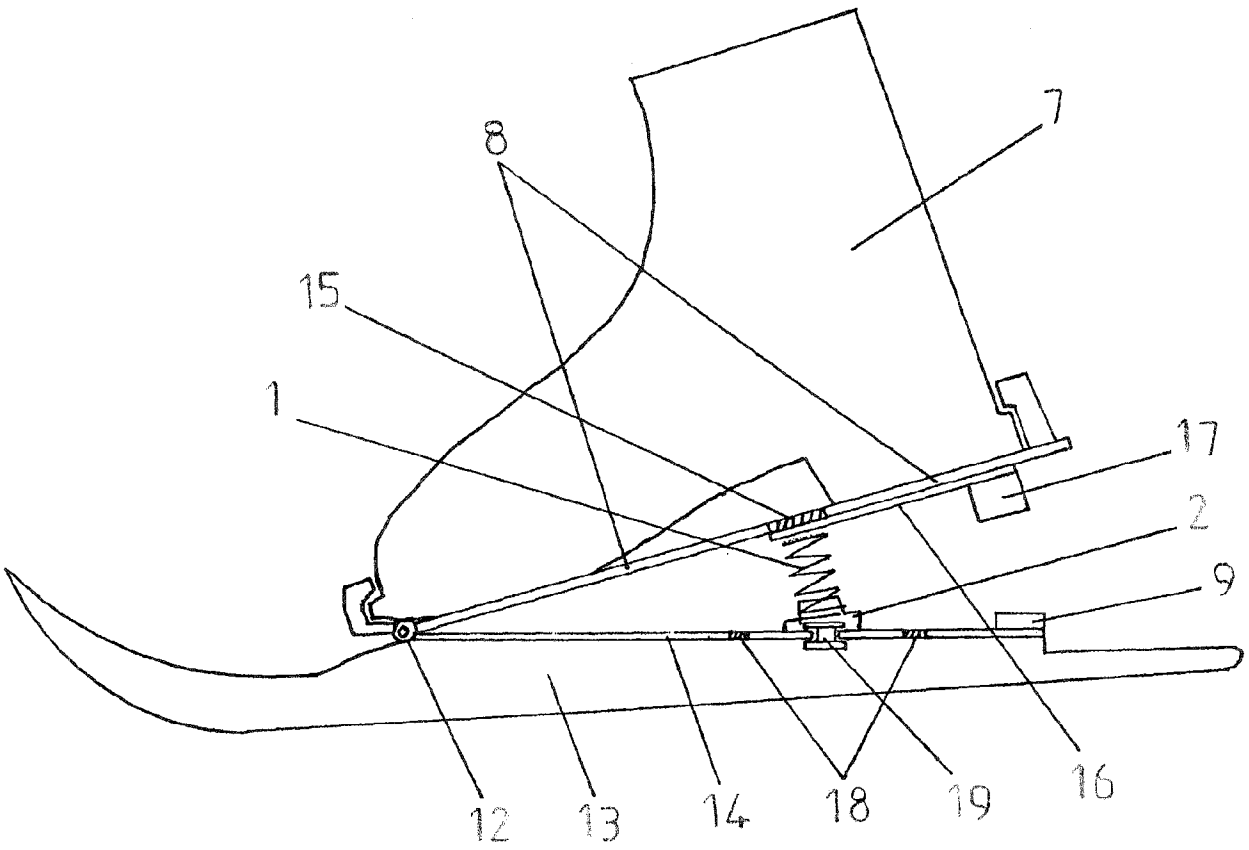
FIG. 3 shows a vertical longitudinal section of the shoe fastening plate, walking board (snowshoe), spring and spring retainer according to the invention, in position for climbing.

For the snowshoe according to a second preferred embodiment of the invention shown in FIG. 3, the shoe 7 is fixed to the shoe fastening plate 8, with the assembly forming the footwear portion. This shoe fastening plate 8 is itself fixed to the stringing 13 of the snowshoe through an axis of rotation 12. A spring 1 fits onto the binding device 2 between the fastening plate 8 and the central platform 14 of the stringing 13, at the arch just before the heel. This binding device 2 is identical to that described above for touring skis. The only difference is that it can be moulded with the central platform 14 of the stringing 13, or, for snowshoes adjustable to the tripper's size, bolted by a bolt 19 into a hole 18 provided for this purpose in the flat central platform 14 of the stringing 13. A stop 9 prevents leverage which might be exerted on the axis of rotation when the spring is fully compressed. This stop 9 is completed by a climbing wedge 17. Before the descent, the spring 1 can be removed by a pivot effect exerted by the tripper's hand, or be placed in a descent position (FIG. 4).

Figure 4:
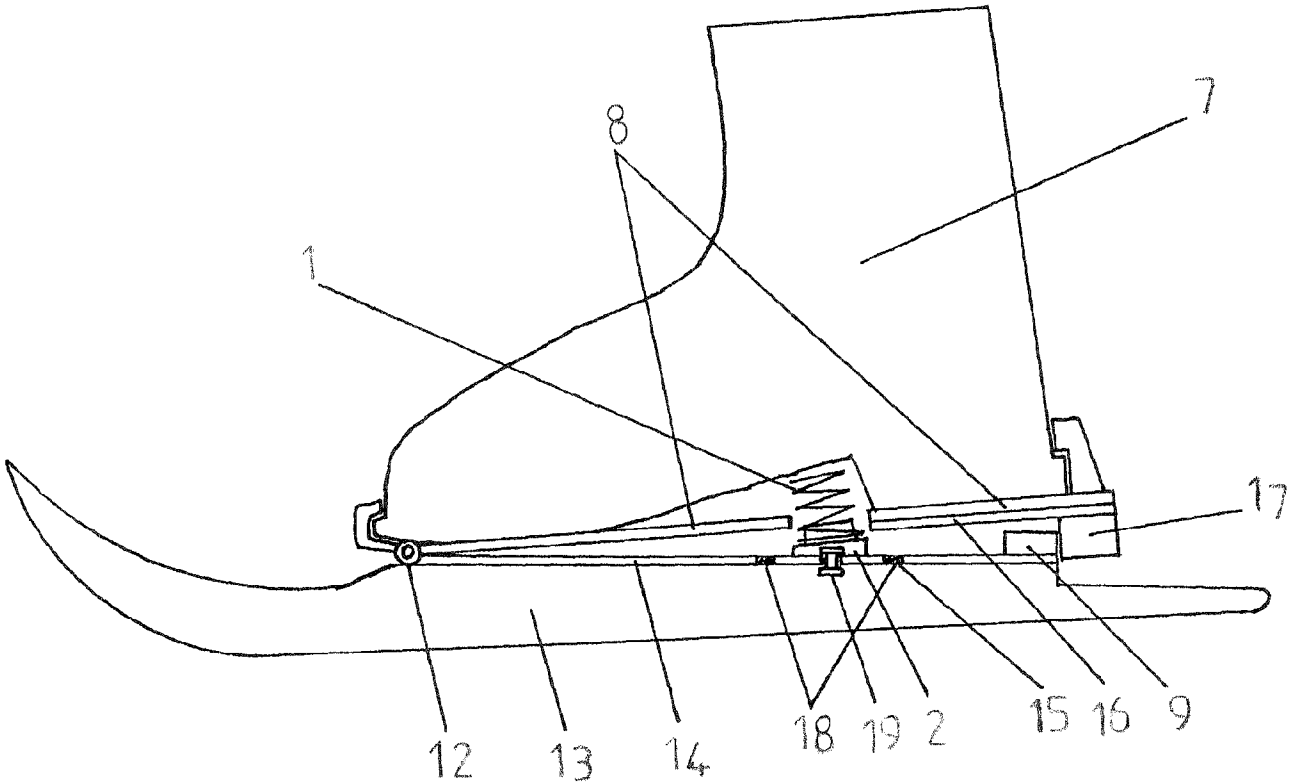
FIG. 4 shows a vertical longitudinal section of the shoe fastening plate, walking board (snowshoe), spring and spring retainer assembly according to the invention, in position for flat parts or descent.
Figure 5:
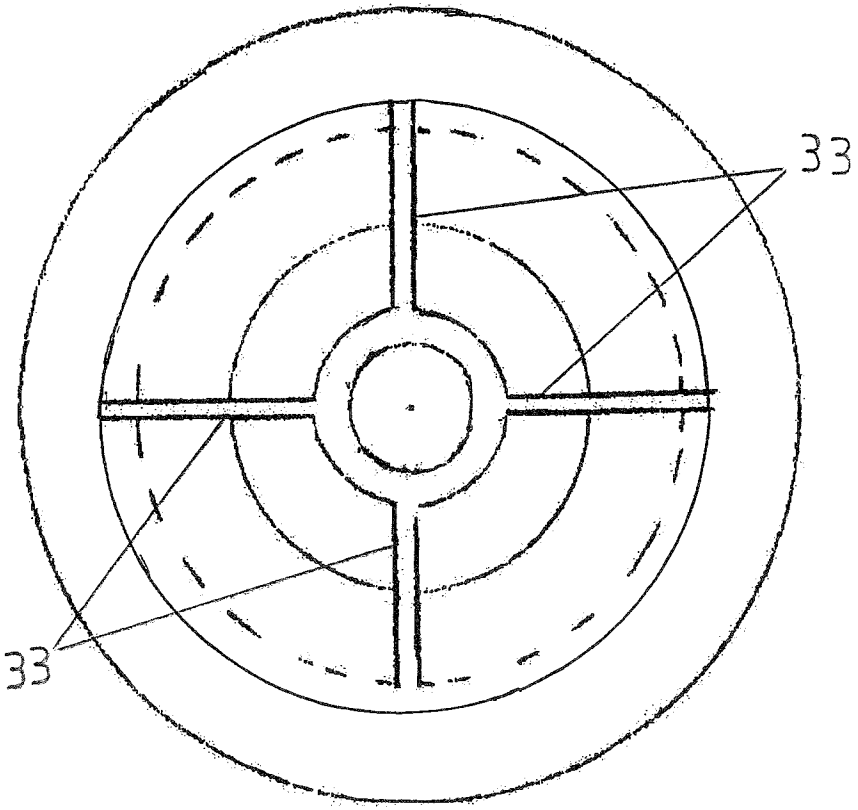
FIG. 6 shows a complete side view and FIG. 5 shows a bottom view of the tip of FIG. 6.

FIG. 4 depicts the same snowshoe as FIG. 3. The snowshoe is here in descent position. A sliding plate 16 positioned on the shoe fastening plate 8 is pulled to clear an orifice 15 above the spring 1 so that the latter can enter therein. This plate 16 then forms a solid element between two operation positions: one active position and one inactive position. In this position, the spring 1 is no longer efficient because its length is such that there is no compression. The climbing wedge 17 no longer rests on the stop 9. The tripper can therefore go down steep slopes without being annoyed by the spring 1 or the climbing wedge 17.

Figure 12:
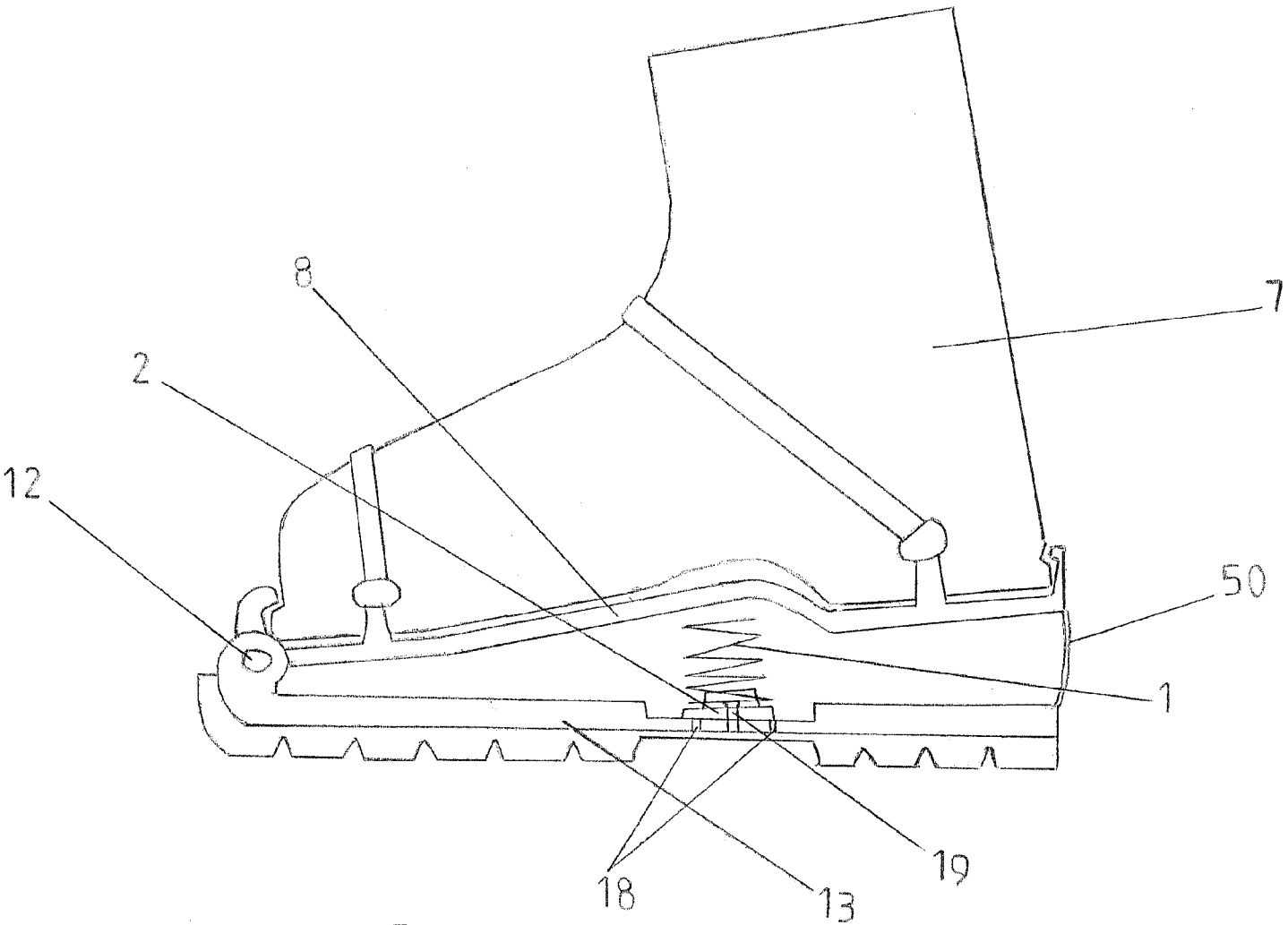
FIGS. 12 and 13 respectively show an application to a walking board and to spikes as walking equipment.

FIG. 12 illustrates an application of the invention to a walking board as walking equipment. A plate 8 joins the shoe 7 at the footwear portion. The plate 8 conforms to that of the base with a recess at the arch, a recess where the bearing zone 34 is located.

Figure 13:
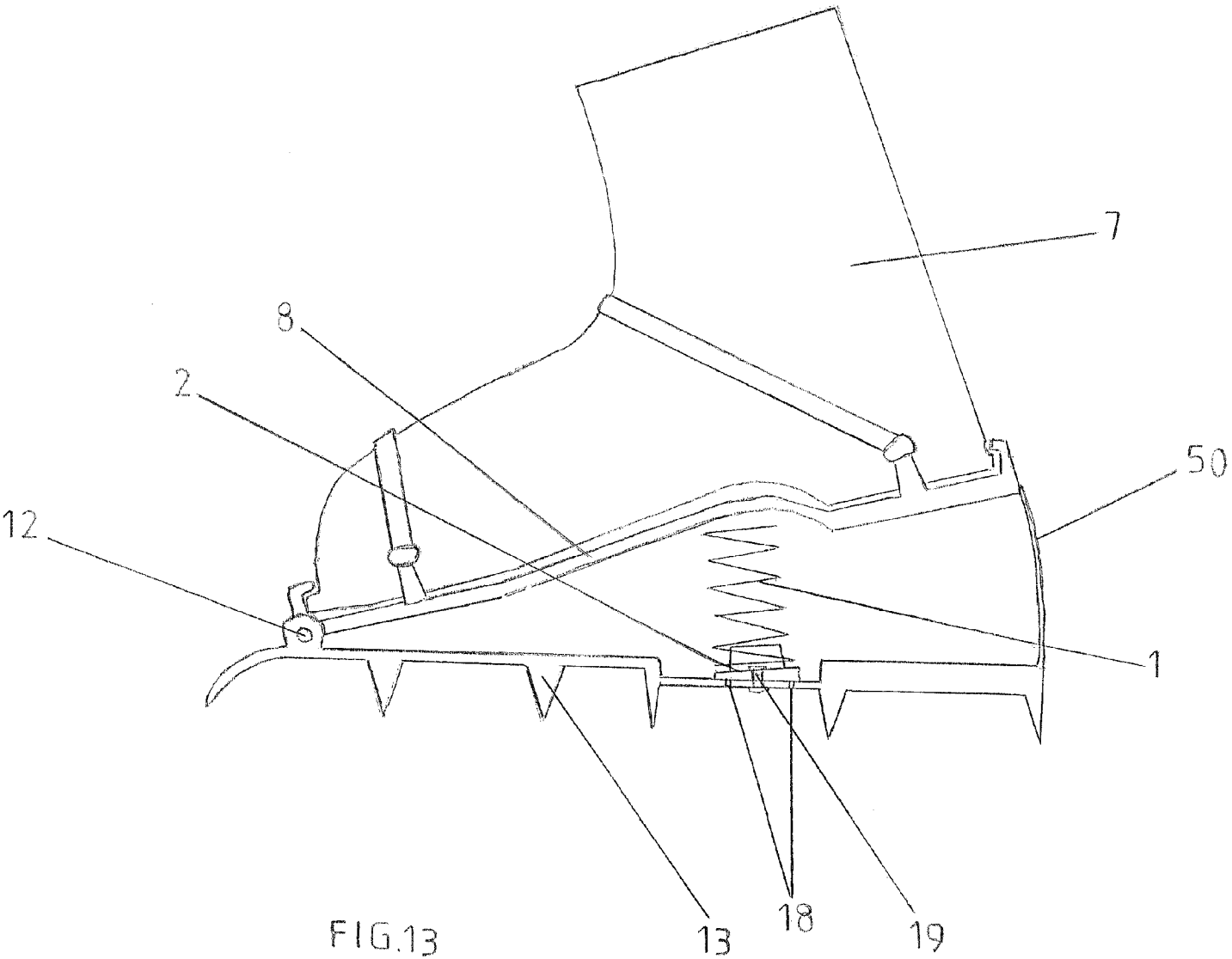

FIG. 13 illustrates an alternative solution to FIG. 12 with a spiked board. In the last two cases, a connection 50 limits the angular movement of the foot relative to the support.

REFERENCES

1. Spring
2. Binding device
3. Screw
4. Sliding board
5. Front binding
6. Binding
7. Shoe
8. Shoe fastening plate
9. Stop
10. Notch
11. Bore
12. Axis of rotation
13. Walking equipment stringing
14. Central platform
15. Orifice
16. Sliding plate
17. Climbing wedge
18. Hole
19. Bolt
20. Spacer
30. Fitting portion
31. Base portion
32. Binding zone
33. Slot
34. Bearing zone
35. Recessed portion
36. Central hole
37. Slide
38. Groove
39. Screw
40. Mounting surface
42. Point pivot
43. Tip
44. Hole
45. Slot
46. Base
47. Tip notch
48. Summit part
49. Sleeve
50. Connection

The invention claimed is:

1. A set of equipment for doing a mountain-sport comprising at least a sliding board or a walking equipment, and at least a system for helping movements of a user's foot, said user's foot being able to be received in a footwear portion, the front end of which is pivotably mounted relative to the sliding board or to the walking equipment, with the system comprising a spring which can be secured to the sliding board or to the walking equipment so as to be applied to a bearing zone of the footwear portion by exerting a pressure on said bearing zone when the bearing zone is moved closer to the sliding board or to the walking equipment, comprising a binding device configured for removeably securing the spring, with the binding device being able to be fastened to a binding zone of the sliding board or of the walking equipment, and wherein the binding zone is located on the sliding board or the walking equipment so as to be able to be positioned opposite a plantar arch of the user's foot.

2. The set of equipment according to claim 1, wherein the spring is a helical spring, one end of which is removeably mounted on the binding device and the other end of which is so configured as to face the bearing zone.

3. The set of equipment according to claim 2, wherein the binding device comprises a groove-shaped notch so configured as to removeably retain at least one turn of the spring.

4. The set of equipment according to claim 3, wherein the notch is situated on a fitting portion extending above a base portion which is wider than the fitting portion.

5. The set of equipment according to the claim 4, wherein the spring abuts on the base portion.

6. The set of equipment according to claim 4, wherein the fitting portion has a tapered shape, the base of which is directed towards the base portion.

7. The set of equipment according to claim 4, wherein the fitting portion is hollow and has at least one longitudinal slot opening at the end of the fitting portion opposite the base portion and so configured as to allow a reversible narrowing of the fitting portion section.

8. The set of equipment according to claim 7, the system comprising at least two slots diametrically opposed around the fitting portion.

9. The set of equipment according to claim 7, wherein each slot has a decreasing width toward the notch and ends at said notch.

10. The set of equipment according to claim 1, wherein the binding device comprises a slide able to be fastened to the sliding board or the walking equipment and an adjustable portion able to be fastened in several positions to the slide, with the adjustable portion being so configured as to removeably fasten the spring.

11. The set of equipment according to claim 1, the system comprising at least one additional spring that can be removeably secured to the binding device in lieu of the spring and differing from the spring by at least one of the following characteristics: the length, the diameter, the stiffness thereof.

12. The set of equipment according to claim 1, the system comprising a tip covering an end of the spring opposite to the binding device and suitable for exerting a pressure on the bearing area.

13. The set of equipment according to claim 12, wherein the tip is removable relatively to the spring.

14. The set of equipment according to claim 12, wherein the face of the tip opposite the bearing zone is not planar.

15. The set of equipment according to claim 1, wherein the footwear portion comprises a shoe, a sole thereof comprises a recessed portion wherein the bearing zone is located, with a height of the binding device being so configured as to insert the binding device into the recessed portion.

16. The set of equipment according to claim 1, wherein the footwear portion comprises a fastening plate pivotally mounted relative to the sliding board or the walking equipment and adapted to receive a sole of a shoe.

17. The set of equipment according to claim 16, wherein said fastening plate cooperates with a movable member whereon the bearing zone is formed, with the movable member being movable between an active position wherein the bearing zone cooperates with the system and an inactive position wherein the system does not cooperate with the bearing zone.

* * * * *